US006905048B2

(12) United States Patent
Harris

(10) Patent No.: US 6,905,048 B2
(45) Date of Patent: Jun. 14, 2005

(54) VOLUMETRIC SOLID AND LIQUID DISPENSER

(76) Inventor: Archie J. Harris, 421 Cox Lake Rd., Stanley, NC (US) 28164

( * ) Notice: Subject to any disclaimer, the term of this patent is extended or adjusted under 35 U.S.C. 154(b) by 84 days.

(21) Appl. No.: 10/305,506

(22) Filed: Nov. 27, 2002

(65) Prior Publication Data

US 2004/0100857 A1 May 27, 2004

(51) Int. Cl.[7] ..... B28C 7/10

(52) U.S. Cl. ..... 222/67; 71/129; 71/169; 366/19; 366/40; 366/152.6; 366/181.3

(58) Field of Search ..... 366/16, 19, 30, 366/33, 40, 179.1, 181.1, 181.3, 183.1, 183.2, 152.6; 222/129, 133, 169, 185.1, 367, 368, 67, 71

(56) References Cited

U.S. PATENT DOCUMENTS 129,330 A * 7/1872 Foote ..... 366/16
984,254 A * 2/1911 Akeley ..... 427/196
1,018,634 A * 2/1912 Seaver et al. ..... 366/33
1,205,088 A * 11/1916 Fietsch ..... 222/142
1,342,456 A * 6/1920 Nagel ..... 222/318
1,438,595 A * 12/1922 Hale ..... 222/192
2,054,042 A * 9/1936 Pipes ..... 366/33
2,772,818 A * 12/1956 McLauchlan ..... 222/368
3,697,054 A * 10/1972 Moratschek ..... 366/18

* cited by examiner

*Primary Examiner*—David Sorkin
(74) *Attorney, Agent, or Firm*—Adams Evans P.A.

(57) ABSTRACT

A volumetric solid and liquid dispenser includes a drum sized for receiving and containing a predetermined volume of solid material from a solid material supply source. The supply source can be a hopper positioned above the drum. The drum is rotatably mounted to a support frame and can be rotated from a position in which it receives solid material from the supply source to a dispensing position in which it dispenses the solid material into a receptacle below. A liquid metering and dispensing container dispenses a predetermined volume of liquid into the receptacle for mixing with the solid material. The invention is particularly useful for dispensing predetermined volumes of sand and water into a cement mixer for mixing with mortar.

20 Claims, 11 Drawing Sheets

VOLUMETRIC SOLID AND LIQUID DISPENSER

TECHNICAL FIELD AND BACKGROUND OF THE INVENTION

The invention relates to an apparatus for metering and dispensing solid and liquid materials. The invention is particularly useful for metering and dispensing certain volumes of sand and water into a cement mixer for mixing with mortar to form cement.

The task of mixing sand, water and mortar mix to form cement is a common activity on construction sites. In order to produce cement of acceptable hardness and quality, the sand, water and mortar must be mixed in specific ratios. The amount of sand and water added to the mixture has a direct impact on the color and hardness of the cement. For example, the amount of sand particularly impacts two important qualities of the cement-color and hardness. Color is particularly important when the cement is being used as a grout, and hardness is critical to virtually every application of cement. As such, masons must take time to accurately measure specific volumes of sand and water to mix with a certain weight of mortar to produce a cement having satisfactory hardness and other desired qualities. A mistake in measuring the sand and water can lead to cement of unacceptable quality causing substantial losses in time and money. In addition, government regulations in recent years have increasingly required cement used in various construction projects to have a certain hardness, making accurate measurement of ingredients all the more critical.

Industry-wide construction standards generally require the cement to have a hardness of 1800 pounds per square inch (p.s.i.). Mortar mix is typically packaged and sold in bags containing seventy-two pounds of mortar. In addition, most commercial cement mixers are designed to receive and mix two seventy-two pound bags of mortar mix. According to industry standards, six cubic feet of sand and approximately ten gallons of water are required to be mixed with 144 pounds of mortar mix to produce cement having a hardness of 1800 p.s.i. As such, it is common for masons to have to measure six cubic feet of sand and ten gallons of water to mix with 144 pounds of mortar mix. Generally, workers measure the sand and water by hand using conventional measuring devices, and then pour the sand and water by hand into the cement mixer along with two bags of mortar. This is a time-consuming and inefficient process that is prone to human error, particularly in the hectic environment of the typical construction site. In addition, the quality of the product can vary depending on the training and skills of the workers measuring and mixing the ingredients. Furthermore, there is a risk of injury to the workers due to the fact that workers must position themselves close to the mixer, which has dangerous blades, in order to pour the sand, water and mortar into the mixer.

In an effort to overcome and eliminate the aforementioned problems, the present invention was conceived.

SUMMARY OF THE INVENTION

Therefore it is an object of the present invention to provide an apparatus capable of efficiently and accurately metering a desired volume of solid and liquid materials.

It is another object of the invention to provide an apparatus for dispensing a certain volume of solid and liquid materials into a receptacle for mixing.

It is yet another object of the invention to provide an apparatus that reduces or eliminates the risk of human error in mixing sand, water and mortar to form cement.

It is yet another object of the invention to provide an apparatus that minimizes the risk of injury to personnel involved in making cement by reducing the number of approaches to the mixer necessary to produce a predetermined amount of cement.

These and other objectives of the present invention are achieved by providing a portable apparatus for dispensing a solid material and a liquid material into a mixer, comprising a drum having an opening therein and sized for receiving and containing a predetermined volume of solid material from a hopper positioned above the drum for allowing free flow of the solid material into the drum. The apparatus includes a discharge assembly for discharging the predetermined volume of solid material from the drum into the mixer, and a container for dispensing a predetermined volume of liquid into the mixer for mixing with the solid material. The drum, hopper and container are mounted on a support frame in an elevated position above the mixer.

According to one preferred embodiment of the invention, the discharge assembly includes a drive apparatus for moving the drum from a receiving position in which the opening in the drum is positioned to receive the solid material, and a dispensing position in which the opening in the drum is inverted to dispense the solid material to the receptacle positioned below the drum.

According to another preferred embodiment of the invention, the drive apparatus includes a wheel mounted to the drum for rotating the drum from the receiving position. The drum opening is upwardly directed for receiving the solid material from the hopper and the dispensing position in which the drum opening is downwardly directed to dispense the solid material from the drum to the mixer positioned below the drum.

According to yet another preferred embodiment of the invention, the drum includes a cylindrical side wall and two opposed lateral end walls, and the drum opening is formed in the cylindrical side wall.

According to yet another preferred embodiment of the invention, a containment shield is positioned adjacent to the cylindrical side wall of the drum and adapted to conform to the cylindrical sidewall and cover the drum opening as the drum is rotated between the receiving and dispensing positions. The containment shield prevents escape of the solid material through the drum opening while positioned between the receiving and dispensing positions.

According to yet another preferred embodiment of the invention, the containment shield includes an arcuate plate extending from a point proximate the drum opening in the receiving position to a point proximate the drum opening in the dispensing position.

According to yet another preferred embodiment of the invention, the drum is rotated approximately one hundred eighty degrees from the receiving position to the dispensing position, and the containment shield includes an arcuate plate extending approximately one hundred eighty degrees around the cylindrical sidewall of the drum.

According to yet another preferred embodiment of the invention, the containment shield includes an inner surface facing the drum, and further comprising an elastic layer affixed to the inner surface for reducing frictional forces resulting from contact between the containment shield and the drum during rotation of the drum.

According to yet another preferred embodiment of the invention, the containment shield includes first and second ends. The first end is pivotally connected to the support frame, and the second end is releasably connected to the support frame. The containment shield is pivotable away from the drum when the second end is released from the support frame.

According to yet another preferred embodiment of the invention, the containment shield includes first and second ends. The first end is pivotally connected to the support frame, and the second end is releasably connected to a spring biased latch attached to the support frame for preventing solid material from lodging between the containment shield and the drum.

According to yet another preferred embodiment of the invention, the hopper includes at least one wall defining a relatively large top opening and converging to a relatively small base opening. The base opening is positioned above the drum and aligned with the drum opening when the drum is in the receiving position.

According to yet another preferred embodiment of the invention, the base opening is not aligned with the drum opening when the drum is rotated out of the receiving position, and solid material stored in the hopper is prevented from entering the drum when the drum is not in the receiving position.

According to yet another preferred embodiment of the invention, at least one guide plate is affixed to the hopper proximate the base opening and contacts the drum proximate the drum opening when the drum is in the receiving position. The guide plate defines a pathway for solid material flowing from the hopper into the drum.

According to yet another preferred embodiment of the invention, the guide plate includes an elastic material to reduce frictional forces resulting from rotation of the drum against the guide plate.

According to yet another preferred embodiment of the invention, the drive apparatus includes a first sprocket mounted on the support frame, and a second sprocket mounted on the drum. A chain connects the first and second sprockets such that rotating the first sprocket rotates the drum from the receiving position in which the drum opening is upwardly directed for receiving the solid material from the hopper, and the dispensing position in which the drum opening is downwardly directed to dispense the solid material from the drum to the receptacle positioned below the drum.

According to yet another preferred embodiment of the invention, an enlarged wheel is mounted on the first sprocket to provide mechanical assistance in manual operation of the drive apparatus. Rotation of the enlarged wheel rotates the first sprocket, the second sprocket and the drum.

According to yet another preferred embodiment of the invention, an electric motor is connected to the first sprocket to rotate the drum.

According to yet another preferred embodiment of the invention, the drum includes a cylindrical side wall and two opposed lateral end walls. The drum opening is formed in the cylindrical side wall and the second sprocket is mounted on one of the lateral end walls.

According to yet another preferred embodiment of the invention, an elongate member is mounted on the support frame and positioned adjacent to the first lateral end surface. At least two stop blocks are positioned approximately one hundred eighty degrees from each other on the first lateral end surface. Contact between the blocks and the elongate member prevents rotation of the drum beyond approximately one hundred eighty degrees.

According to yet another preferred embodiment of the invention, the apparatus includes means for metering a predetermined volume of liquid in the container.

According to yet another preferred embodiment of the invention, the container includes a valve opening in communication with a source for the liquid material. A float is suspended on the liquid material, and is connected to a valve proximate the valve opening such that raising the float to a predetermined level within the container closes the valve over the valve opening to prevent entry of additional liquid material into the container, and lowering the float below the predetermined level opens the valve opening to allow entry of the liquid. The volume of liquid material received in the container is controlled by positioning the float at a corresponding height within the container.

An embodiment of the method for dispensing a predetermined volume of solid material and a predetermined volume of liquid material into a mixer according to the invention includes the steps of providing a dispensing apparatus comprising a drum having an opening therein and sized for receiving and containing a predetermined volume of solid material from a hopper positioned above the drum for allowing free flow of the solid material into the drum. A drive apparatus moves the drum from a receiving position in which the opening in the drum is positioned to receive the solid material from the hopper, and a dispensing position in which the opening in the drum is positioned to dispense the sand to a mixer positioned below the drum, and a container for dispensing a predetermined volume of liquid into the mixer for mixing with the solid material. The drum, hopper and container are mounted on a support frame in an elevated position above the mixer. The drum is positioned in the receiving position, and solid material flows into the drum until it is full. The container is filled with the predetermined volume of liquid, and the liquid is dispensed into the mixer. The drum is rotated to the dispensing position to allow the solid material in the drum to flow through the drum opening and enter the mixer.

An embodiment of the method for making a predetermined amount of cement according to the invention includes the steps of providing a dispensing apparatus comprising a drum having an opening therein and sized for receiving and containing a predetermined volume of sand from a hopper positioned above the drum for allowing free flow of the sand into the drum, a drive apparatus for moving the drum from a receiving position in which the opening in the drum is positioned to receive the sand from the hopper and a dispensing position in which the opening in the drum is positioned to dispense the sand to a mixer positioned below the drum, and a container for dispensing a predetermined volume of water into the mixer for mixing with the sand. The drum, hopper and container are mounted on a support frame in an elevated position above the cement mixer. The drum is positioned in the receiving position to fill the drum with sand from the hopper. The container is filled with the predetermined volume of water, and the water is dispensed into the mixer. The drum is rotated to the dispensing position to allow the sand in the drum to flow through the drum opening and enter the cement mixer. A predetermined volume of mortar mix is added to the cement mixer, and the sand, water and mortar mix are mixed together to form cement.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 5:
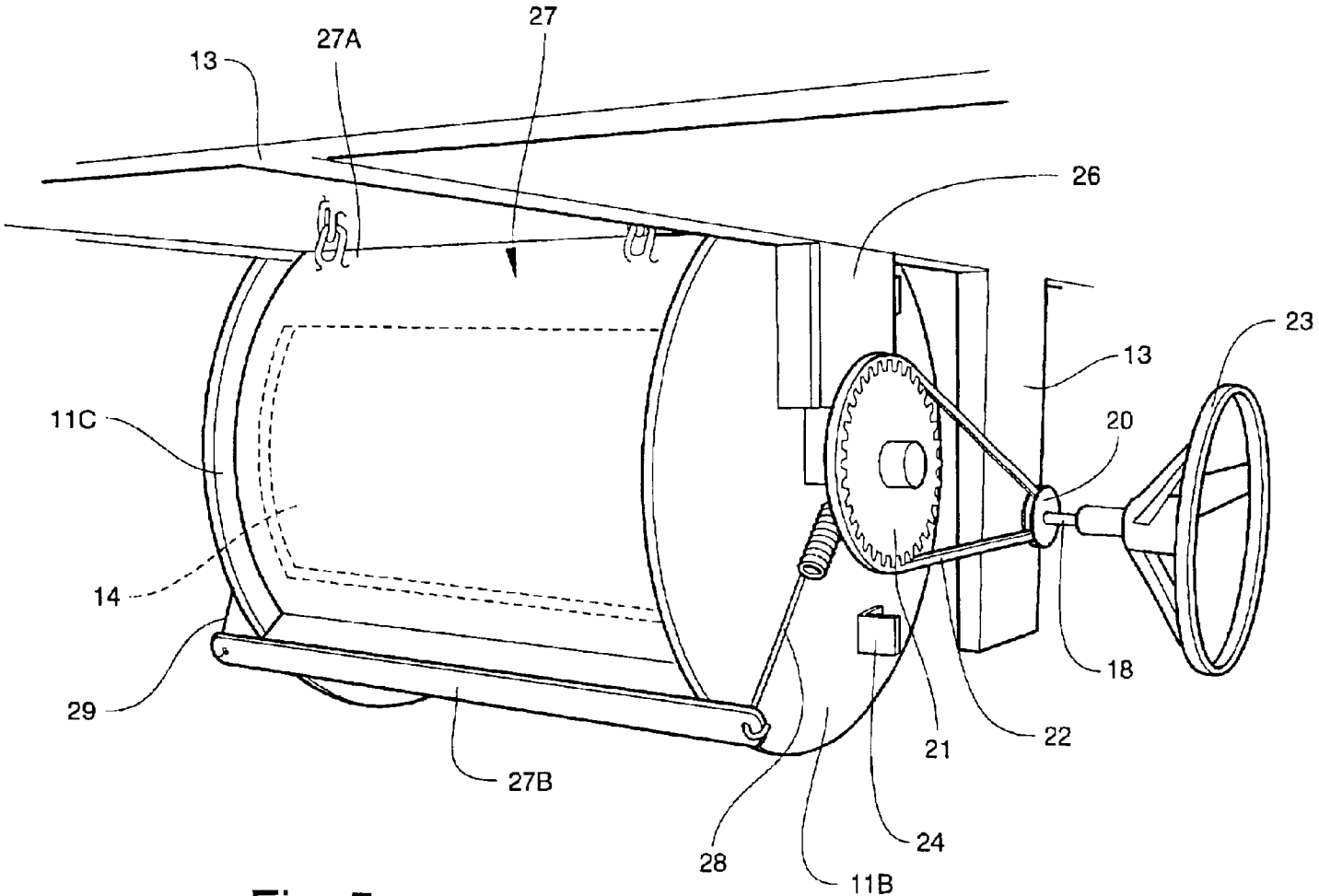
FIG. 5 is a perspective view of the drum of the volumetric solid and liquid dispenser according to a preferred embodiment of the invention.
Figure 6:
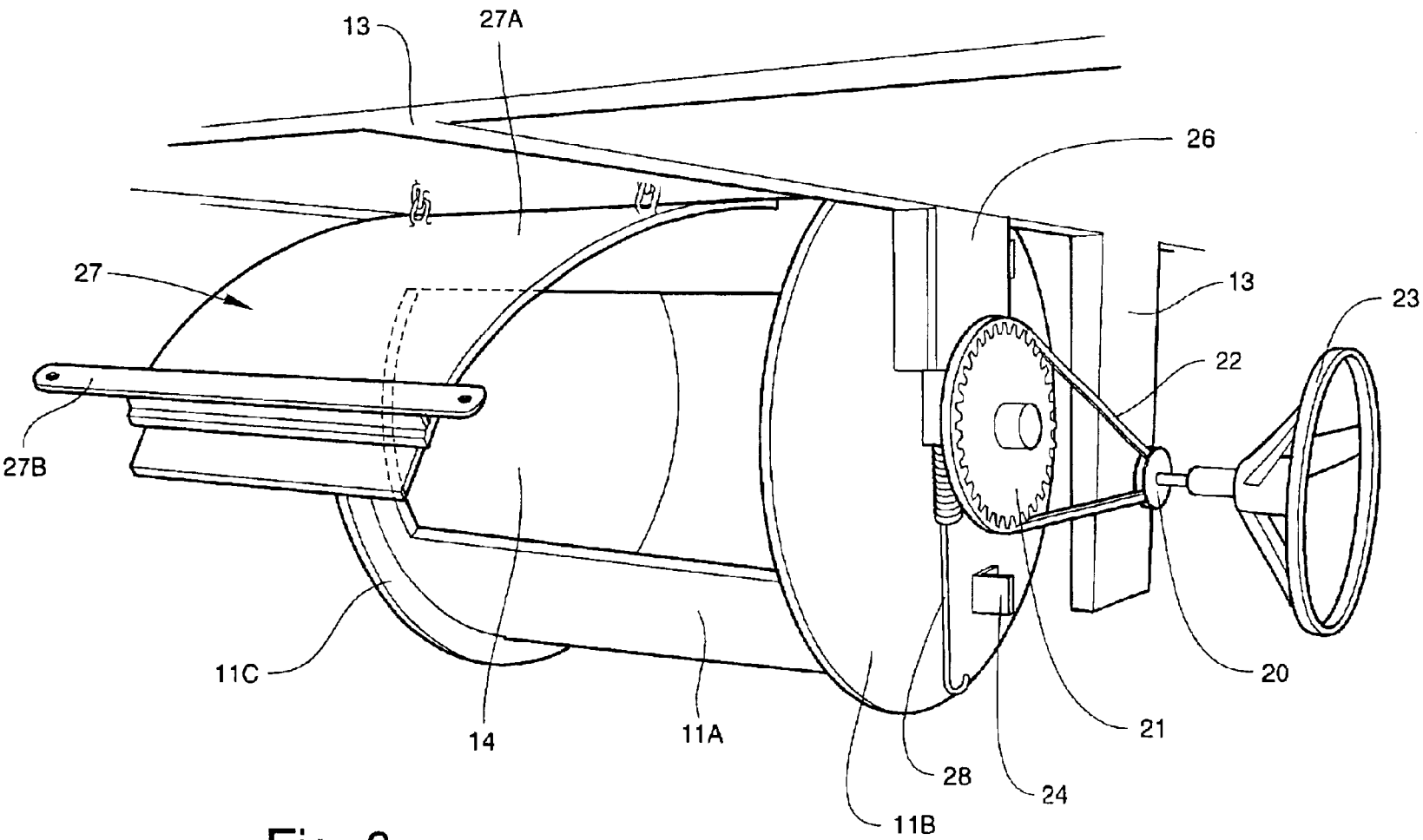
FIG. 6 is another perspective view of the drum of FIG. 5, showing the containment shield pivoted upward.

Referring now specifically to the drawings, a preferred embodiment of the volumetric solid and liquid dispenser according to the present invention is illustrated in FIGS. 1–4, and shown generally at reference numeral 10. The dispenser 10 comprises a drum 11 and a liquid metering and dispensing container 12 mounted on a support frame 13. The drum 11 holds a predetermined volume of solid material and has an opening 14 through which the solid material enters and exits the drum 11, as shown in FIGS. 5 and 6. The container 12 stores and delivers a predetermined volume of a liquid.

While the dispenser 10 can be used to deliver measured volumes of a variety of solids and liquids, the dispenser 10 is preferably used to dispense sand and water in an appropriate volumetric ratio for mixing with mortar to make cement.

Figure 7:
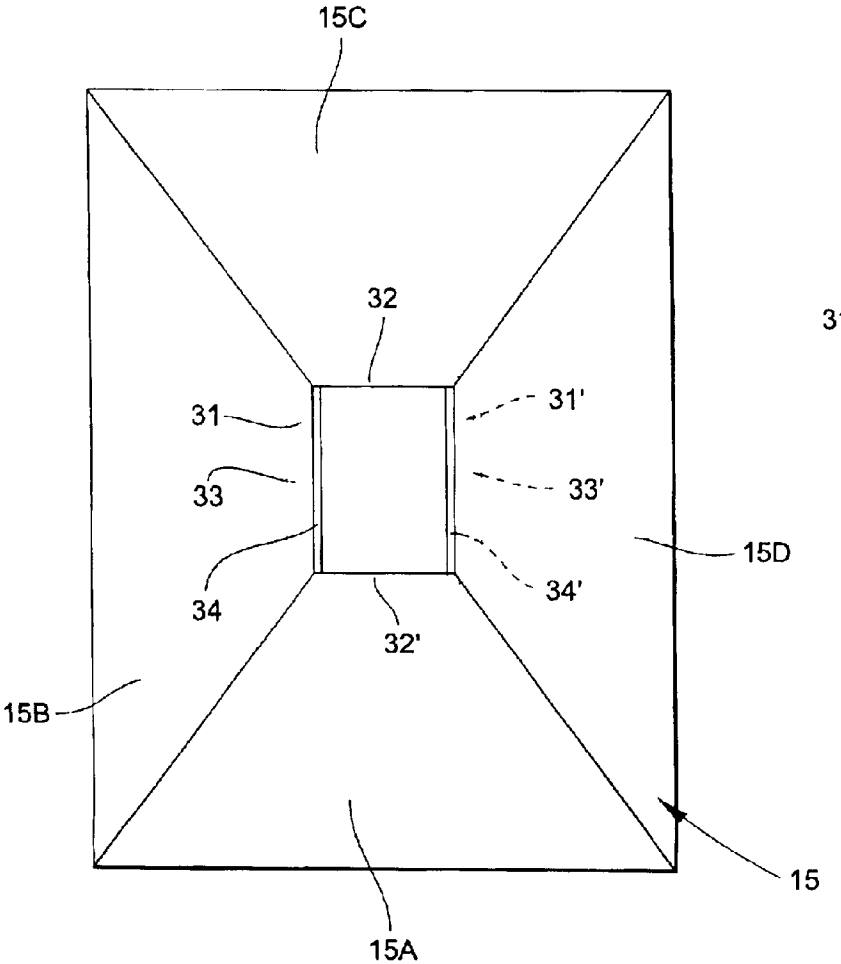
FIG. 7 is a top plan view of the hopper of the volumetric solid and liquid dispenser shown in FIG. 1.

As can be seen in FIGS. 1–4, the dispenser 10 includes a hopper 15 mounted on the support frame 13 above the drum 11. The hopper 15 preferably comprises four walls 15A–D defining a relatively large top opening 16 and converging into a relatively small base opening 17, as shown in FIG. 7. The base opening 17 is positioned directly above the drum 11. The hopper 15 preferably holds approximately forty cubic feet of sand, which can supply the typical crew of eight masons for one full day of work. The sand can be poured into the hopper 15 by a forklift or other suitable equipment.

As shown in FIGS. 5 and 6, the drum 11 preferably comprises a cylindrical sidewall 11A and two opposed lateral end walls 11B, 11C. The drum 11 can be of any volume but is preferably sized to hold six cubic feet of sand.

Figure 8:
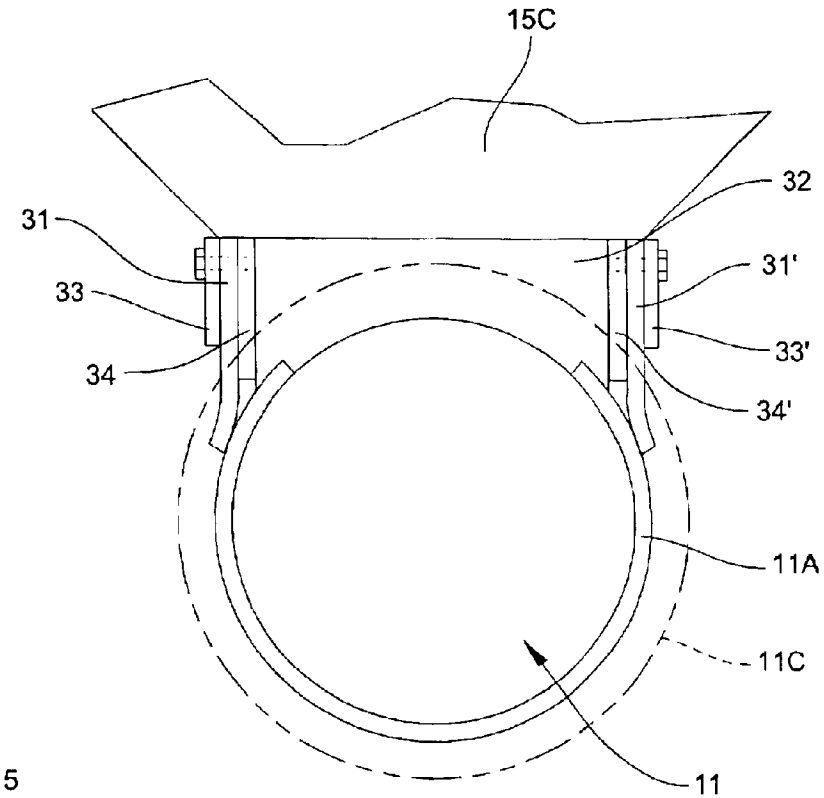
FIG. 8 is a partial cross-sectional view of the volumetric solid and liquid dispenser shown in FIG. 1.

The drum opening 14 is formed within the cylindrical side wall 11A as shown in FIGS. 5 and 6, and is shaped similarly to and sized slightly smaller than the base opening 17 of the hopper 15, as shown in FIG. 8. The drum 11 is rotatably mounted to the support frame 13 such that the drum 11 can be rotated relative to the hopper 15 thereby moving the drum opening 14 in and out of alignment with the hopper base opening 17.

Figure 1:
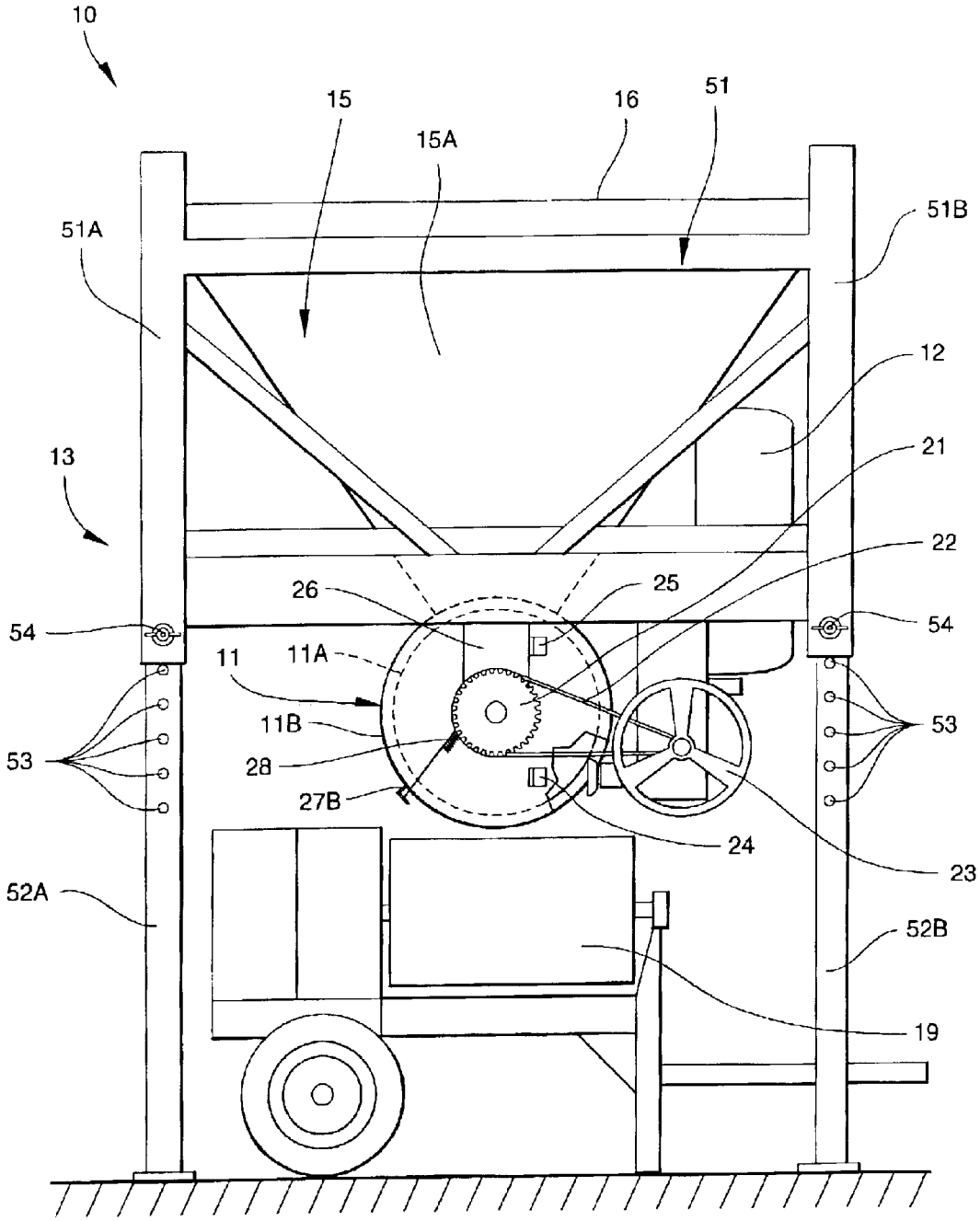
FIG. 1 is a front elevation of a preferred embodiment of the volumetric solid and liquid dispenser according to the invention, shown with a cement mixer.
Figure 9:
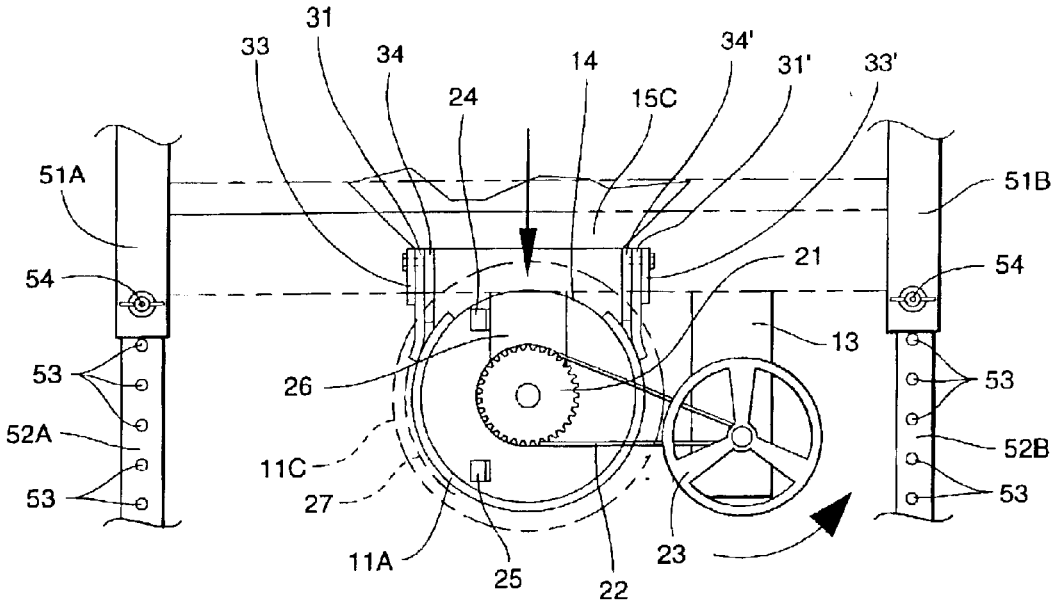
FIG. 9 is a partial enlarged view of the volumetric solid and liquid dispenser shown in FIG. 1.
Figure 10:
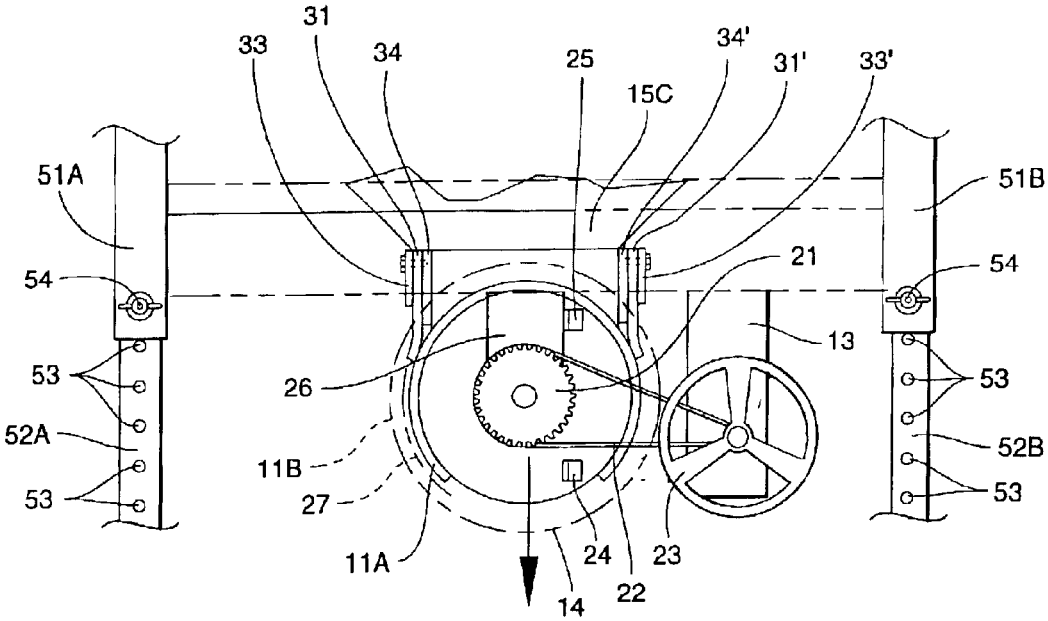
FIG. 10 is another partial enlarged view of the volumetric solid and liquid dispenser shown in FIG. 1.

A drive apparatus communicates with the drum 11 to rotate the drum between a receiving position, shown in FIG. 9, in which the drum opening 14 is upwardly directed and aligned with the hopper base opening 17, and a dispensing position, shown in FIG. 10, in which the drum opening 14 is downwardly directed and aligned with a receptacle 19, shown in FIG. 1. The receptacle 19 is preferably a standard commercial cement mixer.

As shown in FIG. 5, the drive apparatus comprises a drive sprocket 20 rotatably mounted on the support frame 13 and a relatively larger sprocket 21 mounted on one lateral end wall 11B of the drum 11. The sprockets 20, 21 are connected by a chain 22 engaging the teeth of the sprockets 20, 21 such that rotation of the drive sprocket 20 rotates sprocket 21 thereby rotating the drum 11. An enlarged wheel 23 is mounted on the drive sprocket 20 to assist the user in manually rotating the drive sprocket 20. The wheel 23 is preferably twenty inches in diameter and made of stainless steel. Alternatively, an electric motor can be used to rotate the drive sprocket 20.

Figure 2:
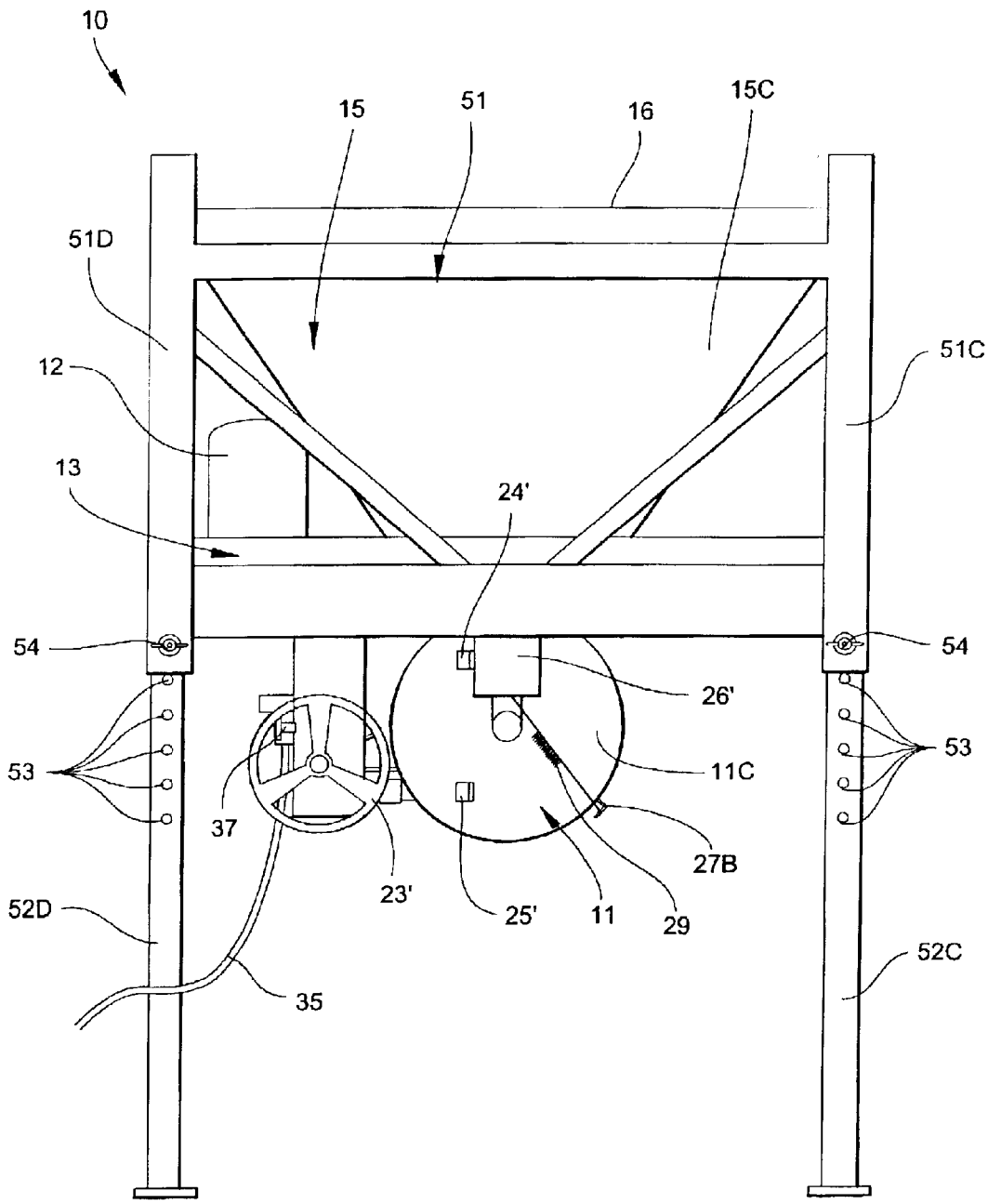
FIG. 2 is a rear elevation of the preferred embodiment shown in FIG. 1.
Figure 3:
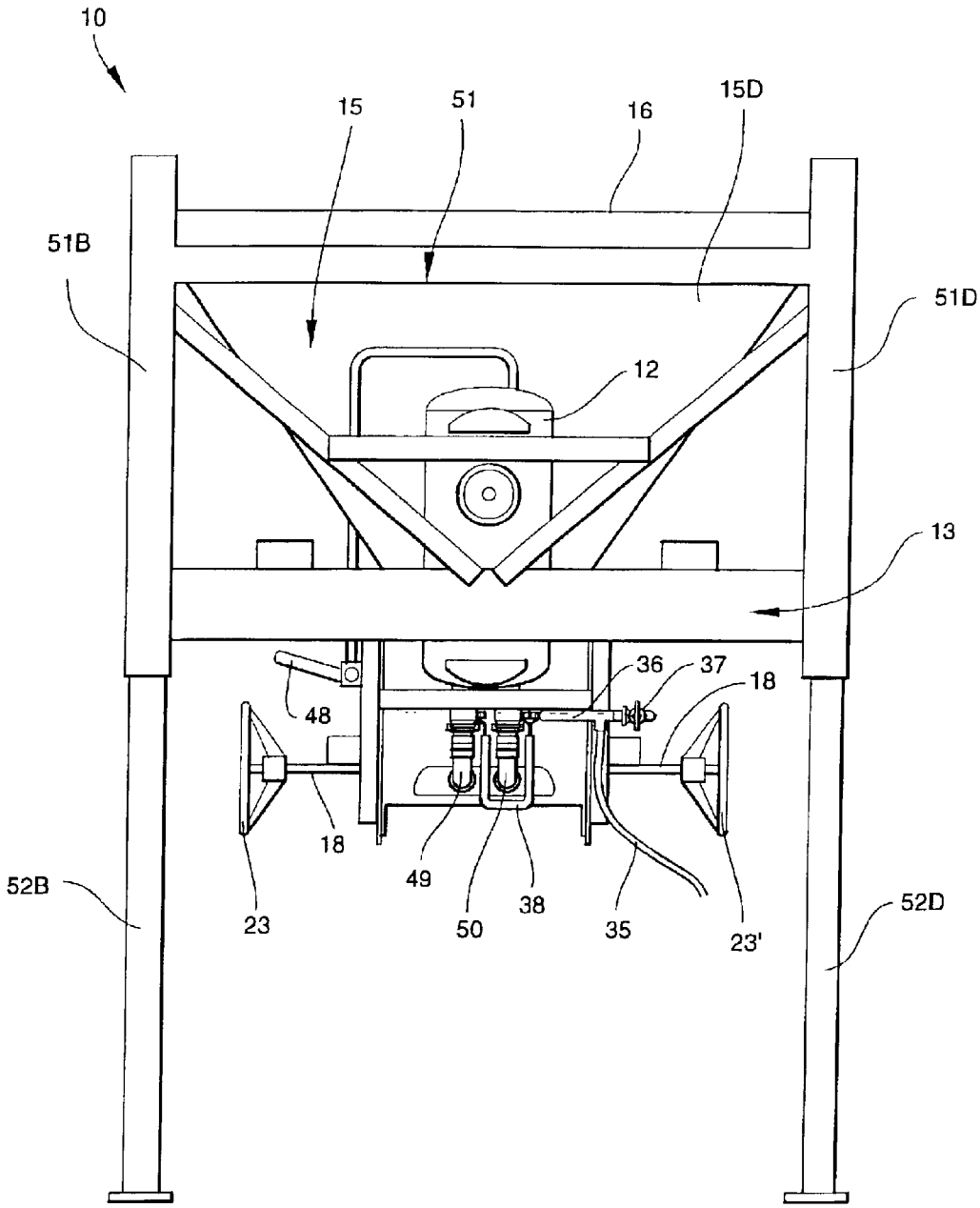
FIG. 3 is a side elevation of the preferred embodiment shown in FIG. 2.
Figure 4:
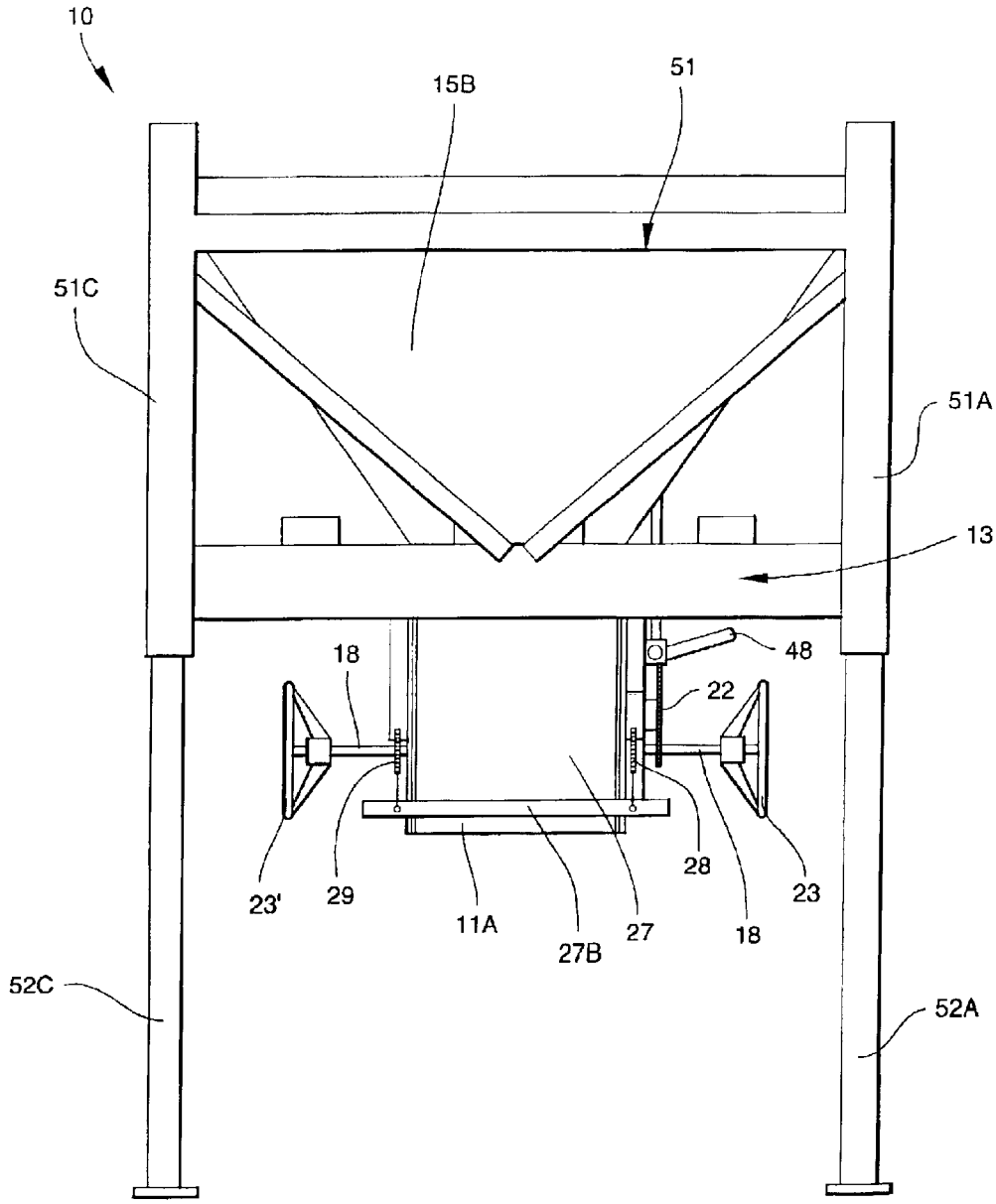
FIG. 4 is another side elevation of the preferred embodiment shown in FIG. 3.

As shown in FIG. 2, the dispenser 10 includes a second enlarged wheel 23' positioned on the opposite side of the support frame 13. The second wheel 23' is connected to the first wheel 23 by an axle 18, enabling the user to operate the dispenser 10 from the front or rear to avoid the wind.

As shown in FIG. 1, two stop blocks 24, 25 are affixed one hundred eighty degrees apart from each other on the lateral end wall 11B. Contact between the stop blocks 24, 25 and an elongate member 26 on the support frame 13 positioned adjacent lateral end wall 11B prevent the drum 11 from rotating more than one hundred eighty degrees. Similarly, stop blocks 24', 25' are positioned on the other lateral end wall 11B, and contact elongate member 26'.

When the drum 11 is positioned in the receiving position, shown in FIG. 9, the drum opening 14 is aligned with the hopper base opening 17 to allow sand contained in the hopper 15 to flow by gravity into the drum 11. Sand flows freely into the drum 11 until it is full with six cubic feet of sand in the drum 11. As shown in FIGS. 9–10, the drum is moved from the receiving position to the dispensing position by rotating the wheel 23 counterclockwise until stop block 25 contacts the elongate member 26, preventing further rotation of the drum 11. As shown in FIG. 10, the drum opening 14 is downwardly directed to allow sand to flow out of the drum 11 by means of gravity and into the cement mixer 19, thereby providing six cubic feet of sand for mixing in mixer 19. The drum can be repositioned in the receiving position by rotating the wheel 23 clockwise until stop block 24 contacts elongate member 26, as shown in FIG. 9. If the user attempts to rotate the drum 11 from the receiving position to the dispensing position when the drum 11 is only partially full of sand, the resulting unbalanced load will cause the drum 11 to move in the opposite direction back toward the receiving position. As such, the user is alerted when the drum 11 is not filled with the desired volume of sand and can reposition the drum 11 to receive additional sand until completely filled.

Figure 11A:
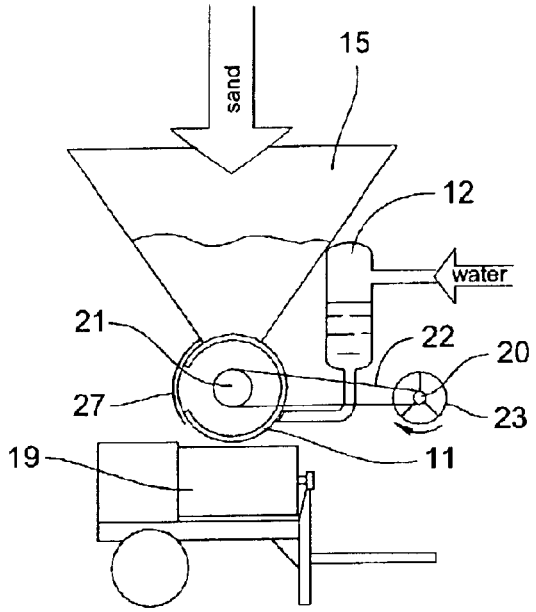
FIG. 11A is a schematic view of the volumetric solid and liquid dispenser of FIG. 1, showing the drum rotating towards the receiving position.
Figure 11B:
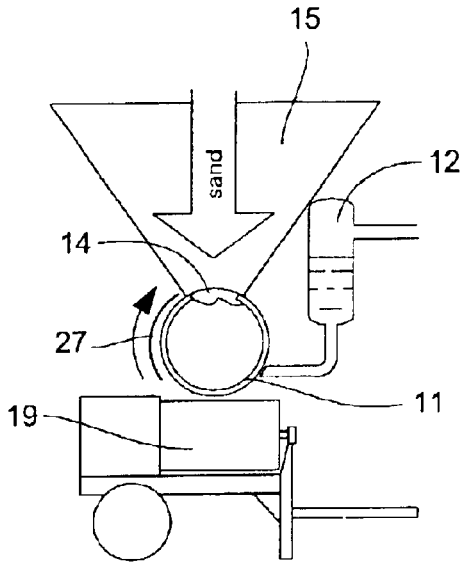
FIG. 11B is a schematic view of the volumetric solid and liquid dispenser of FIG. 1, showing the drum in position to receive sand from the hopper.
Figure 11C:
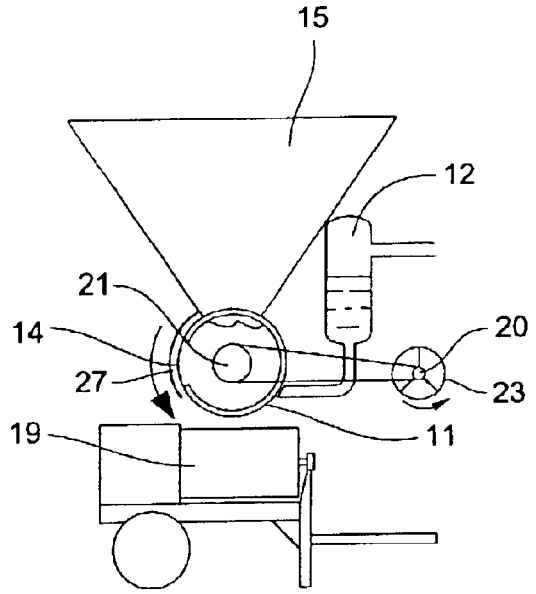
FIG. 11C is a schematic view of the volumetric solid and liquid dispenser of FIG. 1, showing the drum rotating from the receiving position toward the dispensing position.
Figure 11D:
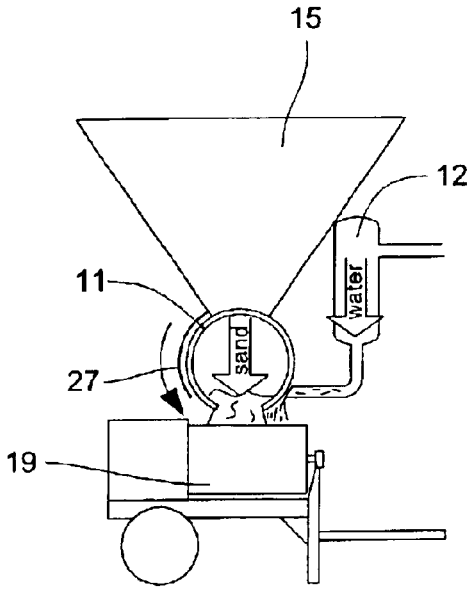
FIG. 11D is a schematic view of the volumetric solid and liquid dispenser of FIG. 1, showing the drum in position to dispense sand into the cement mixer.
Figure 12:
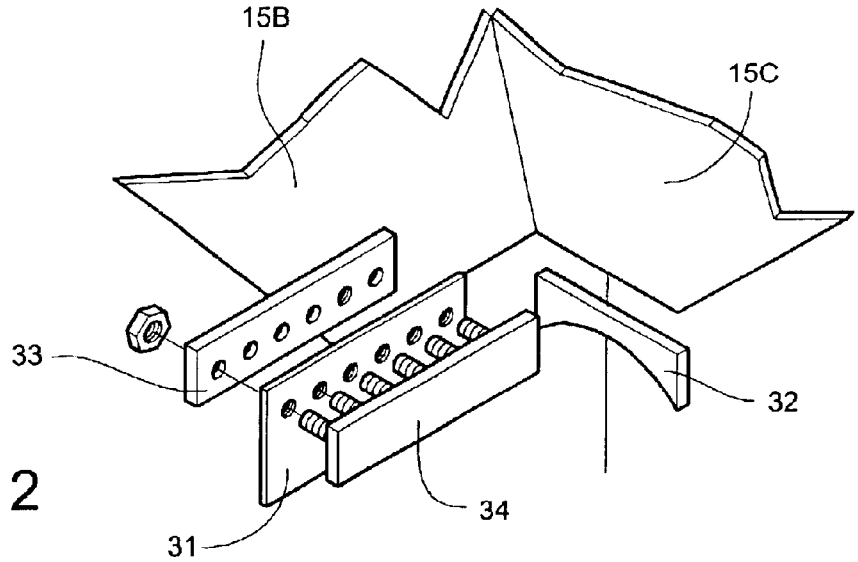
FIG. 12 is a partial enlarged view of the volumetric solid and liquid dispenser of FIG. 1.
Figure 13:
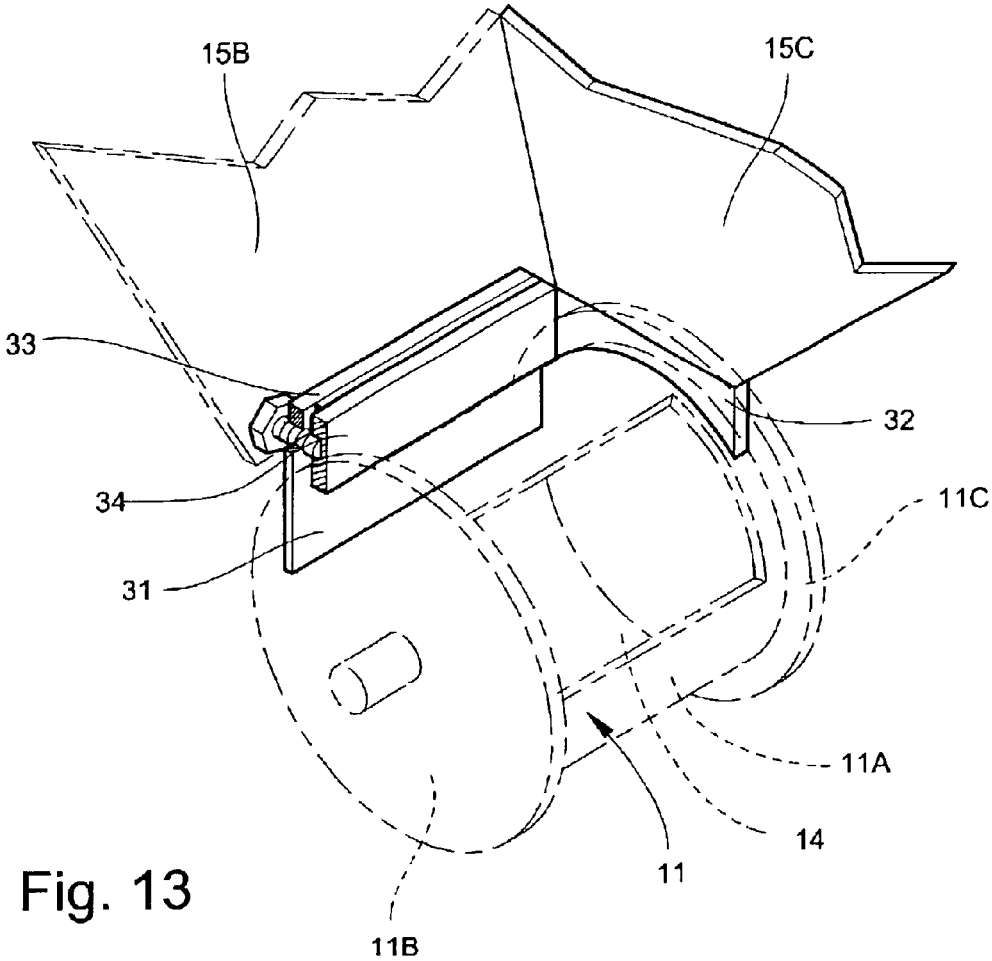
FIG. 13 is another partial enlarged view of the volumetric solid and liquid dispenser of FIG. 1.

As shown in FIGS. 5 and 6, a containment shield 27 is positioned adjacent the drum to prevent escape of sand from the drum 11 due to centrifugal forces while it is being rotated from the receiving position to the dispensing position, as demonstrated in FIGS. 11B–11D. As can best be seen in FIGS. 5 and 6, the containment shield 27 is an arcuate plate sized to conform to the curvature of the cylindrical sidewall 11A. The top end 27A of the containment shield 27 is pivotally mounted to the support frame 13 proximate the hopper 15. The containment shield 27 extends approximately one hundred eighty degrees around the drum 11, and has a terminal end 27B releasably connected to spring loaded latches 28, 29. The spring loaded latches 28, 29 are attached, respectively, to the lateral end walls 11B, 11C of the drum 11. It is common for pebbles, stones and other relatively large errant matter to be present in sand packaged and sold for use in cement. The spring loaded latches 28, 29 securely maintain the containment shield 27 adjacent the cylindrical wall 11A, while providing a resiliency to prevent the permanent lodging of stones, pebbles or other errant material between the containment shield 27 and the drum 11. In the event a stone or pebble flows into the crevice between the drum 11 and containment shield 27 while the drum 11 is being rotated from the receiving position to the dispensing position, the spring loaded latches 28, 29 and the pivotal mounting of the containment shield 26 provide a resilience in the containment shield 27 that allows stones and pebbles between the drum 11 and the containment shield 27 to fall out as the drum 11 rotates. As such, errant stones and pebbles do not remain lodged between the drum 11 and containment shield 27, and rotation of the drum 11 continues uninhibited. As shown in FIG. 6, an elastic mat 30, preferably made of rubber, is affixed to the underside of the containment shield 27 proximate the terminal end 27B to facilitate smooth rotation of the drum 11 by reducing frictional forces generated by contact between the drum 11 and the containment shield 27.

As shown in FIGS. 7 and 8, two elastic segments 31, 31', preferably made of rubber, are affixed to the opposite sides 15B, 15D, respectively, of the hopper proximate the base opening 17 such that the segments 31, 31' extend transversely to the direction of rotation of the drum 11. Two curved segments 32, 32' are affixed to opposite sides 15A, 15C of the hopper 15 proximate the base opening 17 such that the curved segments 32, 32' extend lengthwise in the same direction as the rotation of the drum 11. As shown in FIG. 7, the curved segments 32, 32' are curved at an angle corresponding to the curvature of the drum 11 so that the curved segments 32, 32' and drum 11 compliment each other. As shown in FIG. 7, the elastic segments 31, 31' and curved segments 32, 32' communicate to define a confined pathway for the sand in the hopper 15 to flow through and into the drum 11. In addition, the elasticity of the segments 31, 31 ' facilitate smooth rotation of the drum by reducing friction. As shown in FIGS. 7, 8, 12 and 13, the elastic segment 31 is sandwiched between two connecting panels 33, 34 attached to hopper wall 15B. Elastic segment 31' is similarly positioned between connecting panels 33', 34' attached to hopper wall 15D.

The liquid metering and dispensing container 12 receives and dispenses a desired volume of liquid into the cement mixer 19. The container 12 preferably holds approximately fifteen gallons of liquid water. Preferably, the container 12 receives and dispenses approximately ten gallons of water into the cement mixer 19 for mixing with six cubic feet of sand and 144 pounds of mortar mix.

Figure 14:
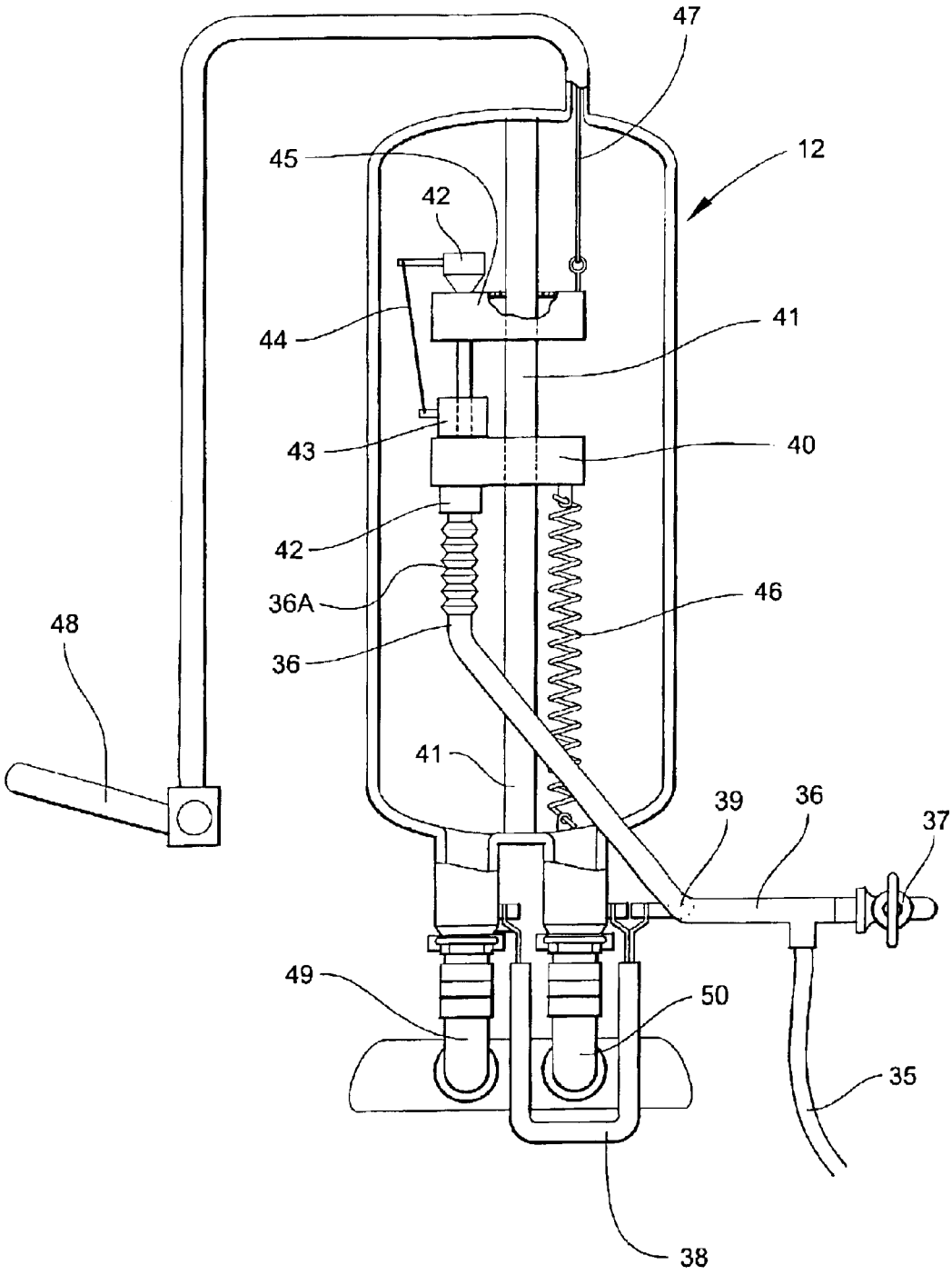
FIG. 14 is a cross sectional view of the liquid metering and dispensing container of the volumetric solid and liquid according to a preferred embodiment of the invention.

As shown in FIG. 14, a supply hose 35 is connected to a water supply source (not shown) and supplies water to a receiving pipe 36. One end of the receiving pipe 36 leads to the container 12, while the opposite end leads to a faucet 37 that provides an auxiliary water supply for cleaning or other work site duties. A control lever 38 communicates with a control valve 39 that is positioned within the receiving pipe 36 prior to entering the container 12 to control the flow of water into the container 12. When the control lever 38 is positioned downward, the control valve 39 is closed and no water can enter the container 12. Moving the control lever 38 upward opens the control valve 39 to allow water to continue to flow through the receiving pipe 36 and ultimately enter the container 12.

As can best be seen in FIG. 14, a filling mechanism is positioned inside of the container 12 that operates similarly to a toilet. The receiving pipe 36 enters the container 12 and terminates at a lower support member 40 positioned midway in the container 12 on a center support rod 41. A filler valve 42 is affixed to the terminal end of the receiving pipe 36. A filler float 43 communicates with the filler valve 42 via a connecting wire 44 to cut off the flow of water into the container 12 once a certain volume of water has been attained. As water fills up the container 12, the float 43 rises with the water. When the float 43 reaches the upper support member 45, the filler valve 42 closes to stop further flow of water into the container 12. As such, the volume of water entering the container can be controlled by positioning of the support members 40, 45 at a certain height on the support rod 41. The lower support member 40 is connected to the base of the container 12 by a spring loaded coil 46 to allow vertical movement of the support members 40, 45 along the support rod 41. In addition, the receiving pipe 36 includes a flexible accordion segment 36A to allow for sufficient vertical movement. Alternatively, the receiving pipe 36 may comprise an elongate flexible tube that is looped to permit sufficient vertical movement of the pipe 36, thereby eliminating the need for the accordion segment 36A. The upper support member 45 is attached to an adjustment cord 47 connected to an adjustment lever 48 mounted on the support frame 13 outside of the container 12. As such, the adjustment lever controls the placement of the support members 40, 45 on the support rod 41, and the volume of water that enters the container 12. Preferably, the position of support members 40, 45 on support rod 41 can be varied such that a volume of four to fourteen gallons of water is received in the container 12.

As shown in FIG. 14, two exit spouts 49, 50 are positioned at the base of the container 12 and extend downward. The exit spouts 49, 50 terminate proximate the drum opening 14 when the drum 11 is in the dispensing position. The control lever 38 communicates with valves positioned within the spouts 49, 50 such that the valves are closed when the control lever 38 is positioned upward, and open when the control lever 38 is positioned downward. As such, water flows into the container 12 and is maintained in the container by the closed exit spouts 49, 50 when the control lever 38 is positioned upward. Moving the control lever 38 downward stops the flow of water into the container 12 by closing control valve 39 and opens the exit spouts 49, 50 to allow the water to flow out of the container 12 and into the cement mixer 19 positioned below the exit spouts 49, 50, as shown in FIG. 1.

As shown in FIGS. 1–4, the support frame 13 comprises an upper section 51 positioned on four lower legs 52A–D. The upper section 51 includes four hollow legs 51A–D, each having a hole formed therein. The legs 51A–D of the upper section 51 are slightly larger than the lower legs 52A–D. The legs 52A–D of the lower section include a series of linearly aligned holes 53 that are spaced apart approximately two inches from each other. The upper section legs 51A–D are telescoped over the lower section legs 52A–D such that the holes of the upper section legs 52A–D are aligned with holes 53 of the lower section legs 52A–D at a desired height. Pins 54 are positioned through the aligned holes to lock the upper section 51 and lower legs 52A–D in place at a desired height. The height of the support frame 13 can be adjusted by removing the pins 54 and aligning the holes of the upper section 51 with higher or lower holes 53 of the lower legs 52A–D.

A preferred embodiment of the dispenser 10 is comprised of stainless steel and has the following dimensions:

Drum 11 has a usable volume of six cubic feet.

Cylindrical sidewall 11A is 24 inches long and has a diameter of 24 inches.

Lateral end walls 11B, 11C have a diameter of 26 inches and is ¼ inch thick.

Drum opening 14 is 23 inches by 15 inches.

Hopper base opening 17 is 24 inches by 15 inches.

A preferred method for making cement using dispenser 10 includes the following steps. First, the support members 40, 45 are positioned on support rod 41 at a height such that the filler valve 42 will close when ten gallons of water is contained within the container 12. Next, the control lever 38 is turned upward, opening control valve 39 and closing exit spouts 49, 50, to allow water to start flowing into the container 12. Water continues to flow into the container 12 until there is ten gallons of water contained within container 12, at which point float 43 reaches upper support member 45 and filler valve 42 closes to stop further flow of water into the container 12. The control lever 38 is then moved downward to open exit spouts 49, 50. The water exits the container 12 and flows into the cement mixer 19 positioned directly below.

Next, one seventy-two pound bag of mortar mix is poured into the cement mixer 19. The drum 11 is positioned in the receiving position, as shown in FIG. 9. Sand flows from the hopper 15 through the drum opening 14 into the drum 11 until it is full. The wheel 23 is then rotated counterclockwise to move the drum 11 from the receiving position to the dispensing position as shown in FIGS. 11C and 11D. Once in the dispensing position, shown in FIG. 10, the six cubic feet of sand contained in the drum 11 empties out through drum opening 14 into the cement mixer 19 positioned below. Another seventy-two pound bag of mortar mix is poured into the cement mixer 19. Finally, the ten gallons of water, six cubic feet of sand and 144 pounds of mortar mix are thoroughly mixed together in the cement mixer 19 to form cement having a compression strength of approximately 1800 p.s.i. The drum 11 can be moved back to the receiving position by rotating the wheel 23 clockwise, as shown in FIGS. 11A and 11B. The invention substantially reduces the number of times the user must approach the mixer to add ingredients. Prior art methods typically required a worker to approach the mixer ten times to make one batch of cement, while the present invention requires only two approaches. By minimizing the number of approaches, the risk of sustaining an injury by contacting one of the blades of the mixer is reduced.

A volumetric solid and liquid dispenser and method of using same is disclosed above. Various embodiments of the invention can be made without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A portable apparatus for dispensing a solid material and a liquid material into a mixer, comprising:

(a) a drum having an opening therein and sized for receiving and containing a predetermined volume of solid material from a hopper positioned above said drum for allowing free flow of the solid material into the drum, wherein said drum includes a cylindrical side wall and two opposed lateral end walls, and the drum opening is formed in the cylindrical side wall;

(b) a discharge assembly for discharging the predetermined volume of solid material from said drum into the mixer;

(c) a container for dispensing a predetermined volume of liquid into the mixer for mixing with the solid material; and (d) a support frame for mounting said drum, said hopper and said container in an elevated position above the mixer; and (e) a containment shield positioned adjacent to the cylindrical side wall of said drum and adapted to conform to the cylindrical sidewall and cover the drum opening as the drum is rotated between the receiving and dispensing positions whereby the containment shield prevents escape of the solid material through the drum opening while positioned between the receiving and dispensing positions, and wherein said containment shield includes first and second ends, said first end pivotally connected to said support frame.

2. A dispensing apparatus according to claim 1, wherein said discharge assembly comprises a drive apparatus for moving said drum from a receiving position wherein the opening in said drum is positioned to receive the solid material, and a dispensing position wherein the opening in said drum is inverted to dispense the solid material to the receptacle positioned below the drum.

3. A dispensing apparatus according to claim 2, wherein said drive apparatus comprises a wheel mounted to said drum for rotating said drum from the receiving position wherein the drum opening is upwardly directed for receiving the solid material from said hopper and the dispensing position wherein the drum opening is downwardly directed to dispense the solid material from said drum to the mixer positioned below the drum.

4. A dispensing apparatus according to claim 2, wherein said hopper comprises at least one wall defining a relatively large top opening and converging to a relatively small base opening, said base opening positioned above said drum and aligned with the drum opening when said drum is in the receiving position.

5. A dispensing apparatus according to claim 4, wherein said base opening is not aligned with said drum opening when said drum is rotated out of the receiving position, whereby solid material stored in said hopper is prevented from entering said drum when said drum is not in the receiving position.

6. A dispensing apparatus according to claim 4, further comprising at least one guide plate affixed to said hopper proximate the base opening and contacting the drum proximate the drum opening when said drum is in the receiving position, said guide plate defining a pathway for solid material flowing from said hopper into said drum.

7. A dispensing apparatus according to claim 6, wherein said guide plate comprises an elastic material to reduce frictional forces resulting from rotation of said drum against said guide plate.

8. A dispensing apparatus according to claim 2, wherein said drive apparatus comprises:

(a) a first sprocket mounted on said support frame;

(b) a second sprocket mounted on said drum; and (c) a chain connecting said first and second sprockets, whereby rotating the first sprocket rotates the drum from the receiving position wherein the drum opening is upwardly directed for receiving the solid material from said hopper, and the dispensing position wherein the drum opening is downwardly directed to dispense the solid material from said drum to the receptacle positioned below the drum.

9. A dispensing apparatus according to claim 8, and further comprising an enlarged wheel mounted on said first sprocket for providing mechanical assistance in manual operation of the drive apparatus whereby rotating said enlarged wheel rotates said first sprocket, said second sprocket and said drum.

10. A dispensing apparatus according to claim 8, and further comprising an electric motor connected to said first sprocket for rotating said drum.

11. A dispensing apparatus according to claim 8, wherein said second sprocket is mounted on one of said lateral end walls of said drum.

12. A dispensing apparatus according to claim 8, and further comprising:

(a) an elongate member mounted on said support frame and positioned adjacent to said first lateral end surface; and (b) at least two stop blocks positioned approximately one hundred eighty degrees from each other on said first lateral end surface, whereby contact between said blocks and said elongate member prevents rotation of said drum beyond approximately one hundred eighty degrees.

13. A dispensing apparatus according to claim 1, wherein said containment shield comprises an arcuate plate extending from a point proximate the drum opening in the receiving position to a point proximate the drum opening in the dispensing position.

14. A dispensing apparatus according to claim 1, wherein said drum is rotated approximately one hundred eighty degrees from the receiving position to the dispensing position, and further wherein said containment shield comprises an arcuate plate extending approximately one hundred eighty degrees around said cylindrical sidewall of said drum.

15. A dispensing apparatus according to claim 1, wherein said containment shield comprises an inner surface facing said drum, and further comprising an elastic layer affixed to the inner surface for reducing frictional forces resulting from contact between said containment shield and said drum during rotation of said drum.

16. A dispensing apparatus according to claim 1, wherein said second end of said containment shield is releasably connected to said support frame, whereby said containment shield is pivotable away from said drum when said second end is released from said support frame.

17. A dispensing apparatus according to claim 1, wherein said second end is releasably connected to a spring biased latch attached to said support frame for preventing solid material from lodging between said containment shield and said drum.

18. A dispensing apparatus according to claim 1, wherein said containment shield comprises an inner surface facing said drum, and further comprising an elastic layer affixed to the inner surface for reducing frictional forces resulting from contact between said containment shield and said drum during rotation of said drum.

19. A dispensing apparatus according to claim 1, further comprising means for metering a predetermined volume of liquid in said container.

20. A dispensing apparatus according to claim 1, wherein said container includes a valve opening in communication with a source for the liquid material, and a float suspendable on said liquid material connected to a valve proximate the valve opening such that raising said float to a predetermined level within the container closes the valve over the valve opening to prevent entry of additional liquid material into the container, and lowering of said float below the predetermined level opens the valve opening to allow entry of the liquid, whereby the volume of liquid material received in the container is controlled by positioning said float at a corresponding height within the container.

* * * * *